US007493670B1

(12) United States Patent
Brogan

(10) Patent No.: US 7,493,670 B1
(45) Date of Patent: Feb. 24, 2009

(54) BUFFING AND POLISHING TOOL

(76) Inventor: Daniel L. Brogan, 2511 NW. 98th Way, Coral Springs, FL (US) 33065

( * ) Notice: Subject to any disclaimer, the term of this patent is extended or adjusted under 35 U.S.C. 154(b) by 181 days.

(21) Appl. No.: 11/506,066

(22) Filed: Aug. 17, 2006

Related U.S. Application Data

(60) Provisional application No. 60/708,809, filed on Aug. 16, 2005.

(51) Int. Cl.
*B24D 9/04* (2006.01)
*B44D 5/10* (2006.01)

(52) U.S. Cl. ..... 15/230; 15/230.19

(58) Field of Classification Search ..... 15/22.1, 15/230, 230.19; 451/177, 540–558
See application file for complete search history.

(56) References Cited

U.S. PATENT DOCUMENTS 2,227,588 A * 1/1941 Kensp ..... 15/230.19
2,800,750 A * 7/1957 Field ..... 451/507
2,826,014 A * 3/1958 Field ..... 451/512
3,129,541 A * 4/1964 Field ..... 451/511
4,533,044 A * 8/1985 Ban ..... 206/362
5,020,282 A * 6/1991 Okajima et al. ..... 451/541
5,233,794 A * 8/1993 Kikutani et al. ..... 451/546
5,781,955 A * 7/1998 Hendricks ..... 15/22.1
5,967,887 A * 10/1999 Synowski ..... 451/358
6,041,919 A * 3/2000 Adams ..... 206/15.3
6,494,315 B2 * 12/2002 Frisk ..... 206/15.3
2006/0111032 A1 * 5/2006 Weston et al. ..... 451/557

FOREIGN PATENT DOCUMENTS

JP 02237772 A * 9/1990
JP 03035979 A * 2/1991

* cited by examiner

*Primary Examiner*—David B Thomas

(57) ABSTRACT

A buffing-polishing tool that attaches to a hand held drill, pneumatic tool or similar machine and may be pre-impregnated with a polishing or buffing compound for cleaning, buffing or polishing wheels, decorative trim and exhaust pipes of cars, trucks, motorcycles and other vehicles, wherein the buffing-polishing tool comprises a pad formed by a foam core and covered with soft cloth or a compressed pad of fiber, a shaft for supporting the pad and mounting it do a drill or similar buffing-polishing machine.

3 Claims, 1 Drawing Sheet

FIG.1
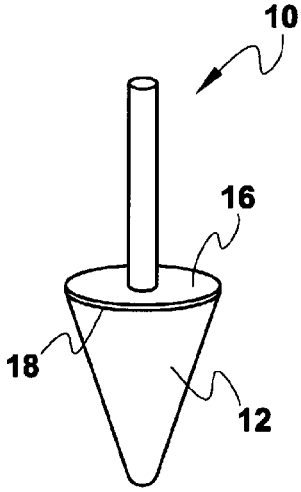
FIG.2
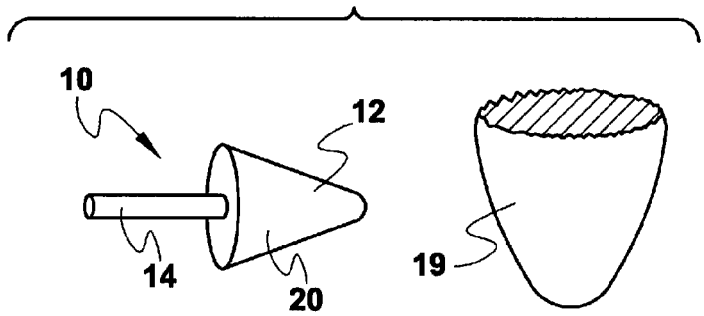
FIG.3
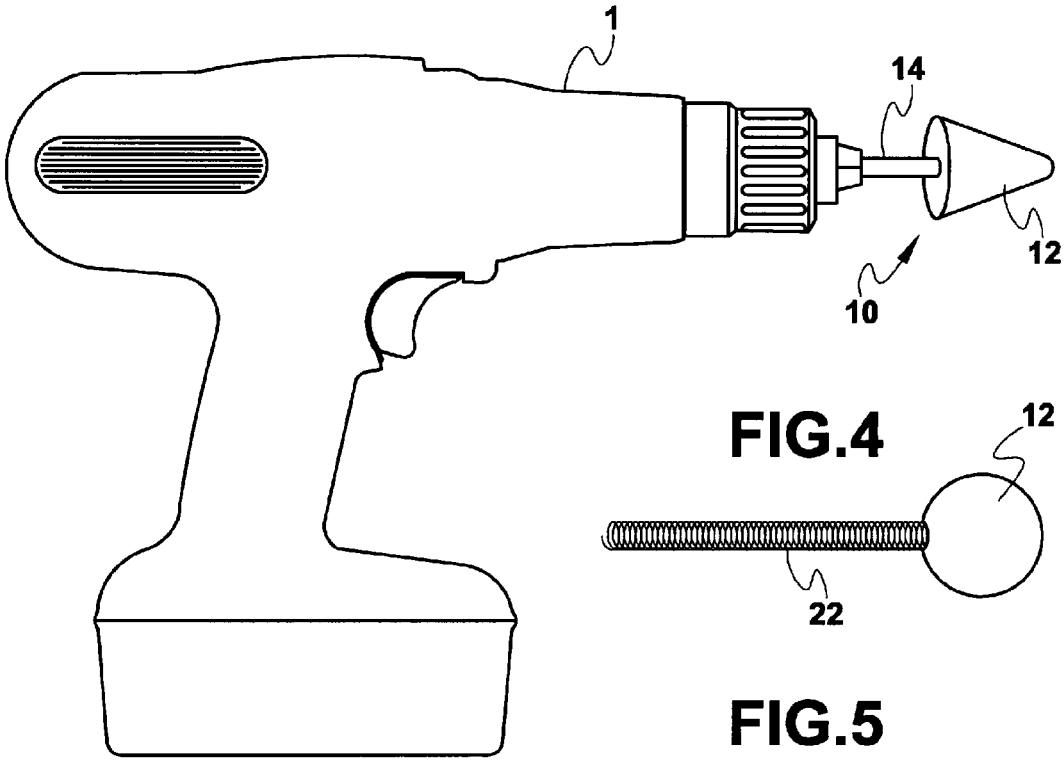
FIG.4
FIG.5
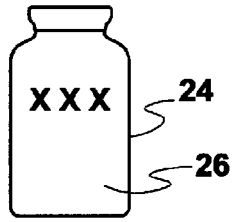

BUFFING AND POLISHING TOOL

CROSS REFERENCE TO RELATED APPLICATIONS

This application claims the benefit of provisional patent application Ser. No. 60/708,809 filed Aug. 16, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a buffing and polishing tool, and more particularly, to a buffing and polishing tool impregnated with a polishing or buffing compound that is used with a drill or air driven machine for buffing or polishing different types of metals.

2. Description of the Background Art

Various buffing and polishing tools are available in the art. Conventional buffing and polishing tools are not always effective or convenient to use. For instance, cleaning agents must be manually applied, which can be messy and result in uneven application. If there existed a more effective and convenient buffing and polishing tool that could also be pre-impregnated with a selected cleaning agent it would streamline the process and be well received. The instant invention addresses this unfulfilled need in the prior art by providing a new buffing and polishing tool as contemplated by the instant invention described herein.

BRIEF SUMMARY OF THE INVENTION

In light of these and other objects, the instant invention comprises a buffing-polishing tool that attaches to a hand held drill, pneumatic tool or similar machine and may be pre-impregnated with a polishing or buffing compound for cleaning, buffing or polishing wheels, decorative trim and exhaust pipes of cars, trucks, motorcycles and other vehicles. The buffing-polishing tool comprises a pad formed by a foam core and covered with soft cloth or a compressed pad of fiber. The invention also comprises a shaft for supporting the pad and mounting it do a drill or similar buffing-polishing machine. The soft foam pads may have different resiliencies, textures, coarseness, stiffness or abrasiveness and may comprise a variety of geometric shapes, such as conical, spherical or tubular. A polishing compound, chemical agent or detergent mixture, such as agents for chrome plate, magnesium, aluminum, stainless steel or gold, may be impregnated in or contained in the foam core. In an alternative embodiment the shaft may comprise a flexible metal spring or similar rigid material.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 1 is a perspective view of the preferred embodiments of the buffing-polishing tool in accordance with the instant invention.

FIG. 2 is a perspective view of the preferred embodiment of the buffing-polishing tool having mixed fibers in accordance with the instant invention.

FIG. 3 is a perspective view of the preferred embodiment of the buffing-polishing tool mounted to a drill in accordance with the instant invention.

FIG. 4 is an elevational view of an alternative embodiment of the buffing-polishing tool in accordance with the instant invention.

FIG. 5 is an elevational view of the preferred embodiments of the buffing-polishing tool in select agents in accordance with the instant invention.

DETAILED DESCRIPTION OF THE INVENTION

With reference to the drawings, FIGS. 1 to 5 depict the preferred and alternative embodiments of the instant invention which is generally referenced as a buffing-polishing tool and, or by numeric character 10. The instant invention 10 provides a buffing-polishing tool that may be pre-impregnated with a polishing compound, detergent mixture, buffing compound or other selected chemical agent designed for a select purpose (hereinafter individually and collectively "chemical agent 26" or "chemical agents 26"). The buffing-polishing tool 10 allows the user to clean, buff and polish wheels, decorative trim and exhaust pipes of cars, trucks, motorcycles and other vehicles using a hand held drill, pneumatic tool or similar machines.

With reference to FIGS. 1-5, the buffing-polishing tool 10 comprises a base/pad 12 formed by a foam core 16 and covered with soft cloth 18 or a compressed pad of fibers 20 having a chemical agent 26. The invention 10 also comprises a shaft 14 for supporting the pad 12 and mounting it do a drill or similar buffing-polishing machine. The pad 12 may be molded on the shaft 14. The soft foam pads 12 may have different resiliencies, textures, coarseness, stiffness or abrasiveness and may comprise a variety of geometric shapes, such as conical, spherical or tubular. The chemical agent 26 may comprise a polishing compound, chemical agent or detergent mixture, such as agents for chrome plate, magnesium, aluminum, stainless steel or gold. The chemical agent 26 may be impregnated in or contained in or on the foam core 16, pad 12 or cloth 18. The invention 10 may include a container for the agents 26 and a lid that supports and suspends the buffing-polishing tool 12 in the container 24 and agent 26. The pad 12 may also comprise an accessory with no impregnation. The shaft 14 is preferably made from a semi-rigid or rigid plastic material. In an alternative embodiment the shaft 14 may comprise a flexible metal spring 22 or similar rigid material, as shown in FIG. 4.

With reference to FIG. 2, an alternative embodiment of the buffing-polishing tool 10 comprises compressed fibers 20 molded into the pad 12 and mounted on the shaft 14. The fibers 20 may comprise a variety of single or mixed fibers. The fibers 20 may be mounted on the shaft 14 to form a cylinder, a cone or other similar geometrical shaped pad 12. The fibers

20 may be graduated in coarseness, stiffness or abrasiveness to provide two or more zones of differing cleaning or polishing ability. The pad 12 made from compressed fibers 20 may be made in different densities ranging from dense brushes to soft polishing pads. The pads 12 may be impregnated with one or more polishing compounds, chemical agents or detergent mixtures 26 either in the wet or dry state.

In another alternative embodiment, the instant invention 10 may include a soft cotton cloth bag 19 that may be placed over the pad 12. The soft cotton bag 19 may be fitted with a drawstring to secure the bag's opening onto the shaft 14 near the base of the pad 12. The soft cotton bag 19 may be disposable or reusable. The bag 19 may be partially filled with an abrasive or polishing compound prior to installation onto the pad 12.

The buffing-polishing tool 10 may be manufactured with a semi-rigid plastic shaft 14, a flexible metal semi-rigid spring 22 or a rigid metal or plastic shaft 14. The pads 12 may be impregnated with a liquid, paste, gel or solid mixture of cleaning agents appropriate for a specific metal, alloy or group of metals. The pads 12 may be impregnated with a liquid, paste, gel or solid mixture of cleaning and polishing agents that need to be wet prior to use. The pads 12 may be manufactured, without any impregnation for cleaning and dry polishing of metals. The pads 12 made from compressed fibers 20 may have different types of fibers 20 embedded in various sections of the pad shape 12 to provide different polishing and buffing properties across the pad 12. The device 10 may be painted, colored or stenciled to display a logo, emblem or other graphic representation.

The foam core 16 in one embodiment may be manufactured from open or closed cell polyurethane, neoprene or silicone foam. The outer cloth 18 covering the foam core 16 may be made from any type of fibers, natural or synthetic, with woven cotton fiber the preferred material of construction. The compressed fibers 20 may comprise a single type or a mixture of natural or synthetic fibers. The fibers 20 preferably comprise cotton fibers or a blend of cotton and nylon or polyester fibers for a synthetic blend construction. The graduation of coarseness in the cone shaped pad 12 may be manufactured from coarse nylon or polyester fibers near the base and a softer mat of cotton fibers near the tip.

The impregnated pads 12 may have different cleaning, oxide removing and polishing agents imbedded in the fiber matrix 20 or foam core 16. The chemical agents 24 may require wetting prior to use to initiate a chemical reaction with the surface coatings on the object to be polished. A mixture containing mild alkaline or acidic compounds may be impregnated or contained in a pad 12. Pads 12 containing chemical agents that preferentially remove surface oxides or sulfides may be manufactured for the cleaning and polishing of specific metals. Pads 12 impregnated with soft abrasives may be manufactured for the polishing of specific metals. Chemical agents that minimize the tendency for dust and dirt to adhere to metal surfaces may be impregnated or contained within the pads 12.

To use the buffing-polishing tool 10, the shaft 14 is placed in a drill, cordless tool or air driven rotary chuck. The rotary tool 1 is then turned on to spin the pad 12, which is placed in contact with the object being cleaned or polished. Wetting the rotating pad 12 may enhance its polishing action. Different grades of pads 12 are provided and selected depending on the object being cleaned and the desired result. The buffing-polishing tool 10 may be reused or discarded when finished.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A buffing and polishing tool comprising: a shaft having a first end and a second opposing end; a conical cleaning pad at the first end of said shaft, said cleaning pad constructed with a foam material; wherein said pad includes a circular base portion and a tip, said pad having a predetermined coarseness that decreases from said base toward said tip; and, a hollow bag having an opening in communication with a hollow interior, said interior configured and dimensioned to receive said pad, said bag constructed with a fabric material whereby a user first uses said pad to clean a surface and subsequently secures said bag over said pad to buff the surface.

2. The tool according to claim 1 wherein said pad is impregnated with a chemical agent used in buffing and polishing surfaces.

3. The tool according to claim 2 wherein said shaft is constructed with a flexible, metallic semi-rigid spring.

* * * * *